US010036991B2

(12) United States Patent
Tanaka

(10) Patent No.: US 10,036,991 B2
(45) Date of Patent: Jul. 31, 2018

(54) CLEANING BLADE AND IMAGE FORMING APPARATUS

(71) Applicant: FUJI XEROX CO., LTD., Tokyo (JP)

(72) Inventor: Daisuke Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/483,613

(22) Filed: Apr. 10, 2017

(65) Prior Publication Data

US 2018/0113413 A1 Apr. 26, 2018

(30) Foreign Application Priority Data

Oct. 26, 2016 (JP) ..... 2016-209600

(51) Int. Cl.
*G03G 15/00* (2006.01)
*G03G 21/00* (2006.01)

(52) U.S. Cl.
CPC ..... *G03G 21/0011* (2013.01)

(58) Field of Classification Search
CPC ..... G03G 21/0011; G03G 21/0017
See application file for complete search history.

(56) References Cited

U.S. PATENT DOCUMENTS

2002/0001487 A1* 1/2002 Tano ..... G03G 15/0818 399/286
2003/0113146 A1* 6/2003 White ..... G03G 21/0035 399/353
2015/0253721 A1 9/2015 Tanaka

FOREIGN PATENT DOCUMENTS

| | | | | |
|---|---|---|---|---|
| JP | 9-292722 | A | | 11/1997 |
| JP | 10-260589 | A | | 9/1998 |
| JP | 2002-82467 | A | | 3/2002 |
| JP | 2003103686 | A | * | 4/2003 |
| JP | 2005-274952 | A | | 10/2005 |
| JP | 2006-91087 | A | | 4/2006 |
| JP | 2013-8007 | A | | 1/2013 |
| JP | 2013-41164 | A | | 2/2013 |
| JP | 2014-85595 | A | | 5/2014 |
| JP | 2015-169846 | A | | 9/2015 |

* cited by examiner

*Primary Examiner* — David M Gray
*Assistant Examiner* — Michael Harrison
(74) *Attorney, Agent, or Firm* — Sughrue Mion, PLLC

(57) ABSTRACT

A cleaning blade includes a resin substrate having a substantially planar shape and a coating layer that covers at least one edge of the resin substrate and that has a connection layer and a surface layer, the connection layer being formed so as to face an interface with the resin substrate and containing diamond-like carbon and at least one selected from the group consisting of titanium nitride, titanium silicon, titanium tungsten, titanium carbide, and titanium carbonitride, the surface layer covering the connection layer and containing diamond-like carbon.

9 Claims, No Drawings

CLEANING BLADE AND IMAGE FORMING APPARATUS

CROSS-REFERENCE TO RELATED APPLICATIONS

This application is based on and claims priority under 35 USC 119 from Japanese Patent Application No. 2016-209600 filed Oct. 26, 2016.

BACKGROUND

Technical Field

The present invention relates to a cleaning blade and an image forming apparatus.

SUMMARY

According to an aspect of the invention, there is provided a cleaning blade including a resin substrate having a substantially planar shape and a coating layer that covers at least one edge of the resin substrate and that has a connection layer and a surface layer, the connection layer being formed so as to face an interface with the resin substrate and containing diamond-like carbon and at least one selected from the group consisting of titanium nitride, titanium silicon, titanium tungsten, titanium carbide, and titanium carbonitride, the surface layer covering the connection layer and containing diamond-like carbon.

DETAILED DESCRIPTION

In image forming apparatuses, a cleaning device is provided to remove a developer remaining on an image carrier or an intermediate transfer belt. An example of the cleaning device is a cleaning blade that includes a substrate formed of a resin, such as polyurethane rubber, and that has an elasticity.

Such a cleaning blade is disposed such that its edge is in contact with a member to be cleaned, and this member is rubbed with the cleaning blade so that a remaining developer is scraped off by the edge. The cleaning blade serves as the cleaning device in this manner.

A cleaning blade according to an exemplary embodiment will now be described. The cleaning blade of this exemplary embodiment includes a blade substrate and a coating layer that covers the surface of the blade substrate.

The blade substrate is a resin substrate having a substantially planar shape, and at least one edge thereof is covered with the coating layer that contains diamond-like carbon as the principle component. This covered edge serves as the part that is in contact with a belt, which is an object to be cleaned, when the cleaning blade is attached in an image forming apparatus.

The blade substrate itself that has not been covered with the coating layer yet is equivalent to an elastic blade that is generally used. The coating layer has a hardness and a small coefficient of friction, which may enhance the wear resistance of the part that is in contact with an object to be cleaned and reduce the friction thereof. In other words, as compared with the case where the blade substrate is directly in contact with the belt, resistance to wear brought about by rubbing the belt is enhanced, and friction with belt is reduced.

Such an enhancement in wear resistance contributes to the prolonged lifetime of the cleaning blade, and the reduction in the friction contributes to an improvement in the cleaning performance thereof.

The resin substrate of the blade substrate can be any of various elastic substrates that are generally used as non-metal cleaning blades. Examples thereof include substrates formed of rubber materials that are known for having elasticity and shape restoration properties, such as polyurethane rubber, silicone rubber, fluororubber, propylene rubber, and butadiene rubber.

It is suitable that the hardness of the rubber material measured in accordance with JIS-A be approximately from 70 to 85.

The coating layer is formed so as to cover at least one edge of the resin substrate having a substantially planar shape and basically a diamond-like carbon (DLC) film; however, the coating layer has a connection layer formed so as to face the interface with the resin substrate in order to further enhance the adhesion of the coating layer to the resin substrate.

The connection layer contains DLC, which is the principle component of the coating layer, as well as at least any of titanium nitride, titanium carbide, titanium carbonitride, titanium silicon, chromium nitride, tungsten carbide, silicon carbide, and titanium tungsten as an anchor material.

The surface layer formed of DLC and covering the connection layer suitably has a thickness ranging approximately from 0.05 μm to 0.3 μm. The larger the thickness of the surface layer is, the harder it becomes that the coating layer follows an elastic change in the shape of the substrate, which results in the easy peeling of the layer. In the case where the surface layer has an unnecessarily small thickness, the reduction in the coefficient of friction of the surface of the blade member, which is the effect brought about by forming the DLC film, becomes insufficient.

The coating film can be formed by a variety of vapor deposition techniques that are generally used to deposit DLC on the surface of the substrate, such as physical vapor deposition (PVD) and chemical vapor deposition (CVD).

The coating layer can be formed by, for example, microwave plasma CVD, direct plasma CVD, Rf plasma CVD, effective magnetic field plasma CVD, ion beam sputtering, ion beam deposition, reactive plasma sputtering, and unbalanced magnetron sputtering.

The source gas used in the formation of the coating layer is carbon-containing gas. Examples thereof include hydrocarbon gas such as methane, ethane, propane, ethylene, benzene, and acetylene; halocarbon such as methylene chloride, carbon tetrachloride, chloroform, and trichloroethane; alcohols such as methyl alcohol and ethyl alcohol; ketones such as acetone and diphenyl ketone; gas such as carbon monoxide and carbon dioxide; and mixtures thereof with $N_2$, $H_2$, $O_2$, $H_2O$, or Ar.

Among a variety of deposition techniques, Filtered Cathodic Vacuum Arc (FCVA) that is ion beam deposition involving use of an arc plasma source is suitably used to form the coating layer.

In FCVA that is one of PVD techniques, carbon is taken directly out of a solid carbon source; thus, as compared with plasma CVD techniques in which hydrocarbon gas is used as a carbon source, the FCVA enables formation of a DLC film having a lower hydrogen content. A DLC film formed by FCVA therefore has a further enhanced wear resistance and reduced coefficient of friction.

In the connection layer, it is suitable that the anchor material content be gradually decreased in the direction of the deposition of the coating layer (direction from the interface with the substrate to the surface layer) rather than the state in which carbon and the anchor material are dispersed at a certain ratio. The part formed without the anchor material after the anchor material content reaches zero corresponds to the surface layer of the coating layer. The Vickers hardness of the surface layer formed of diamond-like carbon is approximately 1500 Hv or more.

Hence, particularly the connection layer is suitably formed by FCVA. Use of FCVA enables formation of the film at an accurately adjusted mixture proportions of gas as a carbon source and gas as an ion source (titanium source, chromium source, tungsten source, or silicon source).

Implantation of ion source gas causes the component of the substrate (nitrogen or silicon) or bonding of carbon to a variety of ions to generate the above-mentioned material of the connection layer, such as titanium nitride, titanium carbide, titanium carbonitride, titanium silicon, chromium nitride, silicon carbide, titanium tungsten, and tungsten carbide.

The resin, which serves as the blade substrate, and the DLC film have a gap in modulus hardness due to the difference in the material thereof. It is speculated that an increase in the gap in modulus hardness leads to an increase in the frequency of peeling of the coating layer resulting from repeated elastic deformation. It is therefore suitable that titanium nitride, titanium silicon, titanium carbonitride, or titanium tungsten be generated at the interface between the blade substrate and the coating layer (connection layer) to form a mixture region in which the resin component of the blade substrate (nitride or silicon) and such titanium and tungsten coexist. The presence of the mixture region enables the gradient of modulus hardness from the resin to the coating layer to be moderate, so that the coating layer becomes further less likely to be peeled off from the blade substrate.

Example 1

Substrate

Polycaprolactone polyol (PLACCEL 205 manufactured by Daicel Chemical Industries, Ltd., average molecular weight: 529, hydroxyl value: 212 KOHmg/g) and another polycaprolactone polyol (PLACCEL 240 manufactured by Daicel Chemical Industries, Ltd., average molecular weight: 4155, hydroxyl value: 27 KOHmg/g) are prepared as soft segment materials of polyol components. An acrylic resin having two or more hydroxyl groups (ACTFLOW UMB-2005B manufactured by Soken Chemical & Engineering Co., Ltd.) is prepared as a hard segment material. The soft segment materials and the hard segment material are mixed with each other at a ratio of 8:2 (mass ratio).

Then, 6.26 parts of 4,4'-diphenylmethane diisocyanate (MILLIONATE MT manufactured by Nippon Polyurethane Industry Co., Ltd.) as an isocyanate compound is added to 100 parts of the mixture of the soft segment materials and the hard segment material, and the reaction is carried out under nitrogen atmosphere at 70° C. for 3 hours. The amount of the isocyanate compound used in this reaction is determined to adjust the proportion of the isocyanate group to the hydroxyl group in the reaction system (isocyanate group/hydroxyl group) to be 0.5.

Then, 34.3 parts of the isocyanate compound is further added, and the resulting product is subjected to a reaction under nitrogen atmosphere at 70° C. for 3 hours to obtain a prepolymer. The total amount of the isocyanate compound used to obtain the prepolymer is 40.56 parts.

The prepolymer is heated to 100° C. and subsequently defoamed under reduced pressure over 1 hour. Then, 7.14 parts of a mixture of 1,4-butanediol and trimethylolpropane (mass ratio: 60/40) is added to 100 parts of the prepolymer, and they are blended with each other over 3 minutes without generation of foams, thereby preparing a composition used for forming a substrate.

The composition used for forming a substrate is poured into a centrifugal molding machine of which the temperature of the mold has been controlled to 140° C. and then subjected to a curing reaction for an hour. The resulting product is subjected to an aging heat treatment at 110° C. for 24 hours and then cooled and subsequently cut off to yield a substrate A that is urethane rubber having a length of 320 mm, a width of 12 mm, and a thickness of 2 mm.

Formation of Coating Layer

A DLC film as a coating layer is formed by FCVA. Using only carbon as an element source enables formation of a pure DLC film containing merely carbon; however, in this Example, gas of a titanium source as an anchor material is mixed with vaporized gas of carbon in the early phase of the deposition in order to form a connection layer having a mixture region that is present at the interface thereof with the substrate.

The composition of the connection layer is analyzed with an X-ray photoelectron spectroscopic analyzer, which shows that the thickness of the surface layer is 200 nm and that the thickness of the connection layer is 133 nm. In addition, the analysis shows that nitrogen as the component of the substrate, titanium, and carbon coexist at the interface between the substrate and the coating layer and that the peaks of the concentrations of the numbers of titanium and nitrogen atoms are 7% and 2.5%, respectively.

The cleaning blade of Example 1 has been produced in this manner.

Example 2

A cleaning blade of Example 2 is produced as in Example 1 except that the substrate is formed of silicone rubber and that the peaks of the concentrations of the numbers of titanium and silicon atoms are 58% and 30%, respectively.

Example 3

A cleaning blade of Example 3 is produced as in Example 1 except that the connection layer is formed so as not to contain nitrogen derived from the component of the substrate (the peak of the concentration of the number of titanium atoms is 10% in the connection layer).

Comparative Example 1

A cleaning blade of Comparative Example 1 is produced as in Example 1 except that a DLC film is formed directly on the substrate A without using titanium source gas in the formation of the coating layer.

Comparative Example 2

In Comparative Example 2, the substrate A itself is used as a blade without the coating layer being formed.

Test of Adhesion

Each of the cleaning blades of Examples and Comparative Examples is brought into contact with a turntable on which a polyimide rubber is lying. In this state, the turntable is rotated by a predetermined number of rotation. Then, the degree of peeling of the coating layer from the edge of the contact surface of the cleaning blade is measured with an electron microscope. The installation angle between the turntable and the cleaning blade is 32°, and a contact pressure is 4.0 gf/mm.

The degree of peeling of the coating layer having the connection layer in each of Examples 1 to 3 after 100 times of rotation is less than or equal to the half of that of the coating layer having no connection layer in Comparative Example 1. The degree of the peeling after 300 times of rotation in Example 1 is compared with that in Example 3, and the degree in Example 1 is approximately from 40% to 60% of the degree in Example 3, which shows that the presence of the mixture region enables a more reduction in the peeling of the coating layer.

Furthermore, this result shows that the cleaning blade of each of Examples enables good rubbing even at a contact pressure of 4.0 gf/mm and an installation angle of 32°.

In Comparative Example 2 in which the substrate A itself is used as a blade without formation of a coating layer, frictional resistance of the cleaning blade to the turntable is so strong that the cleaning blade cannot serve for the rubbing and that the turntable even cannot be properly rotated.

Test of Practicability for Belt Having Surface Roughness Rz of 6.0 μm

The greater the surface roughness of a belt that is to be cleaned is, the more toner particles having a small diameter enter depressions in the surface of the belt, which makes it difficult for a cleaning blade to exercise its cleaning performance. In general, the installation angle of the cleaning blade to the belt is increased to maintain the cleaning performance; however, as the installation angle is increased, the cleaning blade is caught by the belt in the rotational direction of the belt because of the friction thereof against the belt, which causes the blade to bounce or to turn up.

Cleaning blades have such a practical upper limit of the installation angle thereof; hence, the cleaning blade of Example 1 is compared with the cleaning blade of Comparative Example 2, which corresponds to a typical cleaning blade, in order to examine the practical upper limit of the installation angle of the cleaning blade of Example 1.

A belt having a surface roughness Rz of 6.0 μm is used as an object that is to be cleaned. The generally known installation angle of a cleaning blade is approximately 20°, and the belt having a surface roughness Rz of 6.0 μm cannot be well cleaned at such an angle with the cleaning blade of Comparative Example 2 that is a typical cleaning blade. Table 1 shows results of the test.

TABLE 1

| | Occurrence of turn-up of cleaning blade | |
|---|---|---|
| Installation angle | Example 1 | Comparative Example 2 |
| 18° | Absence | Absence |
| 19° | Absence | Absence |
| 20° | Absence | Absence |
| 21° | Absence | Presence |
| 22° | Absence | Presence |
| 23° | Absence | Presence |
| 24° | Absence | Presence |
| 25° | Absence | Presence |
| 26° | Absence | Presence |
| 27° | Absence | Presence |
| 28° | Absence | Presence |
| 29° | Absence | Presence |
| 30° | Absence | Presence |
| 31° | Absence | Presence |
| 32° | Absence | Presence |

TABLE 1-continued

| | Occurrence of turn-up of cleaning blade | |
|---|---|---|
| Installation angle | Example 1 | Comparative Example 2 |
| 33° | Absence | Presence |
| 34° | Absence | Presence |
| 35° | Presence | Presence |
| 36° | Presence | Presence |

The cleaning blade of Comparative Example 2 turns up at an installation angle of greater than 20°; in contrast, the cleaning blade of Example 1 does not turn up until an installation angle of 34°.

Although not shown in Table 1, the bounce of the cleaning blade occurs in some cases in Comparative Example 2 at an installation angle of 20° and in Example 1 at an installation angle ranging from 30° to 34°. The cleaning performance of the cleaning blade of Example 1 is slightly reduced at an installation angle ranging from 20° to 23°.

Accordingly, the suitable installation angle of the cleaning blade of Example 1 is in the range of 24° to 30°.

INDUSTRIAL APPLICABILITY

The exemplary embodiment of the invention can be applied to a cleaning blade and an image forming apparatus in the manner described above.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade comprising:

a resin substrate having a substantially planar shape; and a coating layer that covers at least one edge of the resin substrate and that has a connection layer and a surface layer, the connection layer being formed so as to face an interface with the resin substrate and containing diamond-like carbon and at least one selected from the group consisting of titanium nitride, titanium silicon, titanium tungsten, titanium carbide, and titanium carbonitride, the surface layer covering the connection layer and containing diamond-like carbon, wherein a mixture region in which materials of the resin substrate and the coating layer coexist is present at the interface between the resin substrate and the coating layer.

2. The cleaning blade according to claim 1, wherein the resin substrate is formed of any one selected from the group consisting of urethane rubber, polyimide rubber, silicone rubber, fluororubber, propylene rubber, and butadiene rubber.

3. The cleaning blade according to claim 1, wherein a thickness of the surface layer is approximately from 0.05 μm to 0.3 μm.

4. The cleaning blade according to claim 1, wherein a Vickers hardness of the surface layer is approximately 1500 Hv or more.

5. An image forming apparatus comprising:

a cleaning blade according to claim 1;

an image carrier; and a transfer device that is in contact with a surface of the image carrier to transfer a toner image from the image carrier to a transfer medium.

6. The image forming apparatus according to claim 5, wherein an installation angle between the transfer device and the cleaning blade is approximately from 24° to 30°.

7. The image forming apparatus according to claim 5, wherein a contact pressure of the cleaning blade against the transfer device is approximately from 0.8 gf/mm to 4.0 gf/mm.

8. A cleaning blade comprising:

a resin substrate having a substantially planar shape; and a coating layer that covers at least one edge of the resin substrate and that has a connection layer and a surface layer, the connection layer being formed so as to face an interface with the resin substrate and containing diamond-like carbon and at least one selected from the group consisting of titanium nitride, titanium silicon, titanium tungsten, titanium carbide, and titanium carbonitride, the surface layer covering the connection layer and containing diamond-like carbon, wherein a thickness of the surface layer is approximately from 0.05 μm to 0.3 μm.

9. A cleaning blade comprising:

a resin substrate having a substantially planar shape; and a coating layer that covers at least one edge of the resin substrate and that has a connection layer and a surface layer, the connection layer being formed so as to face an interface with the resin substrate and containing diamond-like carbon and at least one selected from the group consisting of titanium nitride, titanium silicon, titanium tungsten, titanium carbide, and titanium carbonitride, the surface layer covering the connection layer and containing diamond-like carbon, wherein a Vickers hardness of the surface layer is approximately 1500 Hv or more.

* * * * *